US005108256A

United States Patent [19]

Herbst et al.

[11] Patent Number: 5,108,256

[45] Date of Patent: Apr. 28, 1992

[54] AXIAL DRAG REGULATOR FOR LARGE-VOLUME RADIAL COMPRESSORS

[75] Inventors: Reinhold Herbst, Zwingenberg; Hans-Joachim Conrad, Frankenthal, both of Fed. Rep. of Germany

[73] Assignee: Aktiengesellschaft Kuhnle, Kopp & Kausch, Frankenthal, Fed. Rep. of Germany

[21] Appl. No.: 643,496

[22] Filed: Jan. 22, 1991

[30] Foreign Application Priority Data

Jan. 29, 1990 [DE] Fed. Rep. of Germany ..... 4002548

[51] Int. Cl.[5] ..... F04D 29/40

[52] U.S. Cl. ..... 415/182.1; 415/160

[58] Field of Search ..... 415/182.1, 148, 150, 415/151, 159, 160, 161

[56] References Cited

U.S. PATENT DOCUMENTS

| | | | |
|---|---|---|---|
| 2,606,713 | 8/1952 | Bauger | 415/160 |
| 3,973,869 | 8/1976 | Doll et al. | 415/161 |
| 4,013,377 | 3/1977 | Amos | 415/161 |
| 4,022,540 | 5/1977 | Young | 415/160 |
| 4,428,714 | 1/1984 | Mowill | 415/161 |
| 4,681,509 | 7/1987 | Davis | 415/161 |
| 4,780,055 | 10/1988 | Zloch et al. | 415/160 |

FOREIGN PATENT DOCUMENTS 1190796 5/1970 United Kingdom .

*Primary Examiner*—John T. Kwon

*Attorney, Agent, or Firm*—Sandler, Greenblum & Bernstein

[57] ABSTRACT

An axial drag regulator for large-volume radial compressors includes a flow channel which transitions from a first cylinder section via a spherical nozzle-like section into a second cylinder section, which in turn has a barrel face which has an inclination of slightly above 0° and up to 10° with reference to a barrel face which is parallel to the axis of the cylinder sections. The guide vanes supported in the transition plane from the first cylinder section to the spherical section have an axis of rotation which divides the guide vane face at a ratio of $\frac{1}{3}:\frac{2}{3}$. The ratio of the diameter of the first cylinder section to the diameter at the intake of the second cylinder section is between 1.1 and 1.4. The rotation of the guide vanes is carried out by an adjusting ring placed upon the outside of the casing, which actuates the rotatable axle shafts of the guide vanes by the intermediation of an articulated lever.

13 Claims, 3 Drawing Sheets

AXIAL DRAG REGULATOR FOR LARGE-VOLUME RADIAL COMPRESSORS

BACKGROUND OF THE INVENTION

1. Field of the Invention

The present invention is related to an axial drag regulator for large-volume radial compressors, including an axial diffusor with a ring of guide vanes extending axially with respect to the axis of the charger and being rotatable around radially extending rotatable axle shafts. The guide vanes are substantially circle sectors of such a shape and pitch that, when the diffusor is totally closed, they nearly cover the total cross section of a flow channel which is formed within a casing. The inner wall of the casing, when seen in the flow direction, comprises a first barrel of a first cylinder section and a barrel of a spherical section, the spherical radius of such spherical section being equal to the radius of the first cylinder section, and the spherical section transitioning smoothly, nozzle-like, into a second cylinder section. Adjusting levers are disposed along the axle shafts of the guide vanes and project outward and extend along the axes of rotation of the guide vanes. The adjusting levers are coupled to an adjusting ring concentrically enclosing the casing.

2. Description of Background and Other Information

Such an axial drag regulator is disclosed in German Patent No. 1,628,232 for large volume compressors and serves to shift the characteristic curve. In such known axial drag regulator, the flow channel in which the guide vanes of the axial diffusor are disposed, includes two barrel sections having only slightly different diameters, and a spherical section between the two barrel sections The diameter of such spherical section is larger than the diameter of the larger cylinder barrel section, i.e. the diameter of the flow channel on the intake side increases in the guide vane region. Such diameter increase in the flow channel causes turbulence and flow separation and an increase of the vortex trail triggered by a velocity jump at the guide vanes. Since the cylinder barrel section adjacent to the spherical section on the compressor side has an only insignificantly smaller diameter than the first cylinder barrel section, a fast suppression of the flow disturbances prior to entering the compressor is not possible, in particular, because the compressor is located in close proximity to the axial drag regulator.

U.S. Pat. No. 1,978,128 discloses an axial drag regulator in which the guide vanes of the axial diffusor are disposed in a housing which transitions from a larger diameter to a smaller diameter by way of a polygonal housing. The rotatable axle shafts of the guide vanes are inclined at a certain angle with respect to the longitudinal axis of the flow channel and are guided in the center of the flow channel in a gear unit which causes a considerable disturbance of the flow. The various guide vanes are coupled by the gear unit in order to guarantee synchronism. The end of the rotatable axle shafts of the various guide vanes opposed to the gear unit is supported approximately in the center section of the polygonal housing, so that the leading edges of the guide vanes extend approximately perpendicularly with respect to the center line when they are in the completely opened condition. Due to the polygonal shape of the housing wall, the gap between the guide vanes and the barrel face may be kept relatively small when the guide vanes are in their completely open condition; however, considerably large gaps appear both at the leading edge and the trailing edge when the vanes are slightly rotated in the direction towards the closed position, as is usual in normal operating conditions, the gaps causing a turbulence of the flow which causes a vortex trail which cannot be suppressed before it reaches the adjacent compressor.

In European Patent No. 243,596, an axial drag regulator for an exhaust gas turbo-charger is disclosed. A spherical section is contiguous to the first cylinder section of the flow channel, which transitions like a nozzle into a second cylinder section, and at the same time into the intake section of the exhaust turbo-charger. This nozzle-shaped spherical section causes a steadying of the flow behind the axial diffusor; in particular, because of the relatively large diameter relation between the intake cylinder section with respect to the output cylinder section. In such an axial drag regulator for exhaust turbo-chargers, the rotatable axle shaft of the respective guide vanes is disposed within the trailing edge of the vane. This one-sided bearing of the guide vanes causes the appearance of relatively high flow forces which, in the case of axial drag regulators for large-volume compressors, not only are undesirable but necessitate very expensive constructional measures.

SUMMARY OF THE INVENTION

It is an object of the present invention to create an axial drag regulator for large-volume radial compressors in which the flow is disturbed as small as possible by the diffusor, and the vortex trails caused by the unavoidable turbulences are suppressed before reaching the compressor, so that an equal, smooth incident flow is obtained over the total cross section of the impeller.

The present invention advantageously suppresses vortex trails and follow-up depressions by exerting adjusting forces as low as possible at the guide vanes by accelerating the flow in the area of the spherical section on the one hand, and by subsequent acceleration in the second cylinder section on the other hand. Due to the disposition of the axes of rotation of the various guide vanes along a radius extending in the first third of the guide vane width, the reset forces may be considerably reduced due to the creation of an equalizing face, without the disadvantages of the prior art, which are unavoidable in the case of a central position of the axis of rotation. In this arrangement, the larger portion of a guide vane extends into the spherical section when the guide vanes are in a totally open position. With the disclosed bearing of the guide vanes, there results a flush extension for the area between the axis of rotation and the trailing edge of the vane between the guide vane and the barrel face of the spherical section, so that there is no turbulence at the trailing edge of the vane which continues in the form of a vortex trail. The necessarily appearing small gap at the vane leading edge causes a turbulence; however, its vortex trail is suppressed within the nozzle-like extending spherical section due to the acceleration of the flow. Moreover, the provision of a continuously decreasing diameter in the second cylinder section down to the leading edges of the impeller blades creates a further acceleration stretch which, in connection with the impeller hub, causes the incident flow to be even and free of vortices over the total cross section.

According to one aspect of the invention, ratios of the diameters of the first cylinder section to the second cylinder section between 1.1 and 1.4 and preferably between 1.22 and 1.39 have proved to be especially suitable for the advantageous effects of the invention, the diameter of the second cylinder section being measured at the intake end of the section. With respect to the continuously decreasing diameter of the second cylinder section it is furthermore provided that its barrel face has an inclination with respect to an axis-parallel barrel face which is slightly larger than 0° up to a maximum of 10°. Especially advantageous results have been obtained when the inclination is up to a maximum of 7°.

The adjustment of the guide vanes caused by means of an adjusting ring is effected by an adjusting lever and a coupling member. The adjusting lever is located on the rotatable axle shaft of the guide vane and extends with its longitudinal axis in the direction of the longitudinal extension of the guide vane. Due to the use of an adjusting lever and a coupling member, there is the possibility of effecting the rotation of the guide vanes in the usual area of rotation of the guide vanes with the most advantageous torque by means of suitable angular coordination between the adjusting lever and the coupling member, i.e. in such areas of rotation, the least rotation forces are required. Accordingly, the angle between the adjusting lever and the coupling member is advantageously 90° when the guide vanes are in a "medium" or central position. The adjusting ring is fixed by suitable stops, so that a rotational area ranging from 15° to −90° is possible, the diffusor being totally closed at the −90° position.

In addition, an indicator is coordinated with the adjusting ring, which shows the respective position of the guide vane on a scale.

BRIEF DESCRIPTION OF THE DRAWINGS

The invention is further explained in the following description with reference to the drawings illustrating, by way of non-limiting examples embodiments of the invention wherein.

DETAILED DESCRIPTION OF THE PREFERRED EMBODIMENTS

Figure 1:
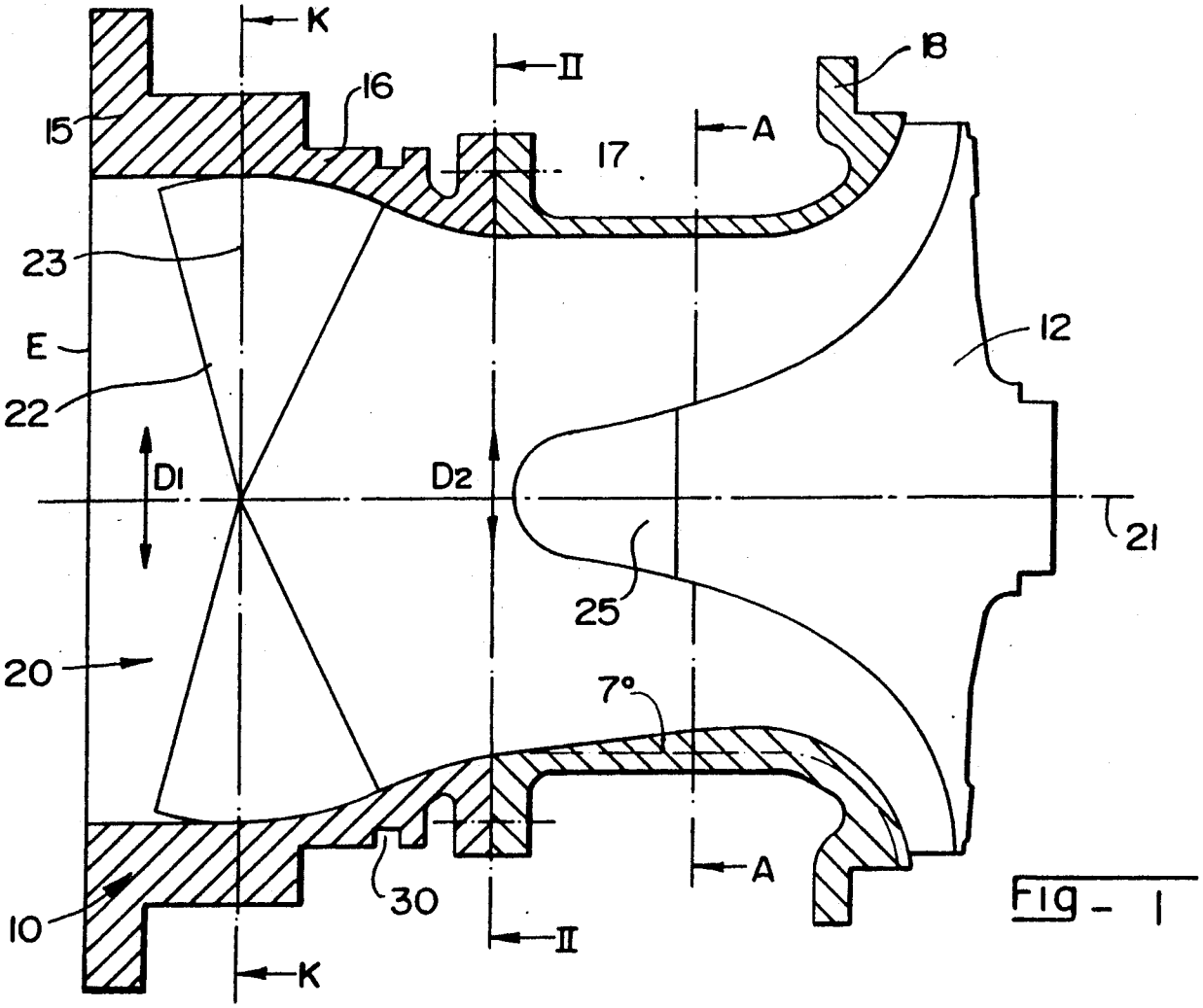
FIG. 1 is a schematic section view through the housing of an axial drag regulator attached to a compressor casing.

FIG. 1 shows a schematic view of casing 10 of an axial drag regulator which is connected by flanges, in the plane II—II, to the casing of a radial compressor with an impeller 12. FIG. 1 shows a compressor casing above the center line, which differs from that below the center line. Such a difference results from the differing impeller sizes and the configuration of the section of the casing as represented between the plane II—II and the plane A—A, which is different in regard to the inclination of the inner face. The respective impeller is accordingly differently dimensioned.

The casing 10 of the axial compressor includes a first cylinder section 15 between the intake plane E and the plane K—K, and a spherical section 16 between planes K—K and the assembly plane II—II. Adjacent to the assembly plane is the second cylinder section 17 which extends up to the intake plane A—A of an impeller 12. Following is a section of the compressor casing 18 which is coordinated with the impeller.

A diffusor 20 is located within the casing 10 of the axial drag regulator, which includes a ring of rotatable guide vanes 22 extending radially with respect to the compressor center line 21, and which are rotatable about radially extending rotation axes. The axes of rotation 23 of the guide vanes 22 are disposed in the plane K—K and extend perpendicularly with respect to the compressor centerline 21.

The spherical section 16 of the casing 10 has a spherical radius which is equal to the radius of the first cylinder section 15 so that the spherical section has a nozzle-like decreasing cross section which transitions or changes into a further continuously decreasing diameter which deviates from the spherical radius in the assembly plane II—II. The second cylinder section 17 follows the assembly plane, the barrel face of which includes an inclination of slightly over 0° up to 10° with respect to a barrel face which would be parallel to centerline 21. In the upper half of the drawing, in accordance with FIG. 1, such an inclination is represented to be slightly over 0°, whereas in the lower half of the drawing, in according with FIG. 1, an embodiment is shown in which the inclination of the barrel face has the order of magnitude of between 7° and 10°. This results in a further reduction of the cross section from the assembly plane II—II towards the intake plane A—A of the compressor which effects, in connection with the hub 25 having an aerodynamic profile, a further acceleration of the flow, and thereby a further smoothing of the flow. This results in a uniform incident flow across the total cross-section of the impeller 12.

Figure 4:
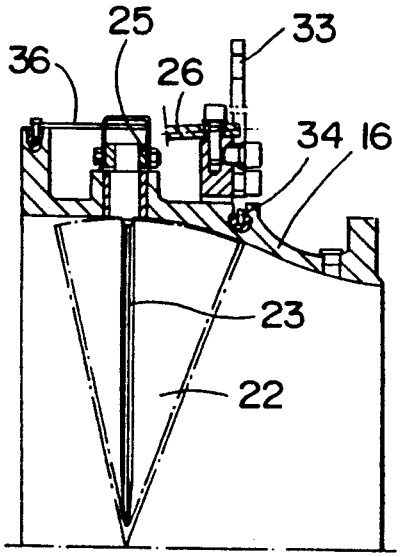
FIG. 4 is a partial section view through the housing of the axial drag regulator and the bearing of a guide vane in an open condition.

The guide vanes 22 are rotatably supported in the plane K—K and are supported on one side so that the guide vane face is divided by the axis of rotation 23 at the ratio of $\frac{1}{3}$: $\frac{2}{3}$, the rotatable axle shaft being located in the diameter plane in the transition areas from the first cylinder section 15 to the spherical section 16. Based upon this construction as shown in FIGS. 1 and 4, the larger vane portion only extends into the spherical section 16 when in a totally opened condition, the leading edge running along a circular curve extending flush along an inside barrel face of the spherical section 16 leaving only a small gap. This arrangement practically prevents the generation of eddies or follow-up depressions on the compressor side of the guide vanes.

The one-sided support of the guide vanes at the first third of the guide vane surface results in an especially advantageous compromise as regards the action of the forces on the guide vanes due to the flow and the generation of turbulence within the flow, since the gap forcibly appearing between the axis of rotation and the front final point of the circular leading edge is in the area of the first cylinder section 15 causes a disturbance of the flow and triggers turbulence. The small turbulence in the flow which take effect in the gap area are suppressed in the area of the axial drag regulator by the nozzle-shaped reduction of the cross-section in the spherical section 16, so that a flow substantially free of disturbances results on exit from the diffusor.

It has been found that, as regards the condition described above, an optimum of uniform flow incidence on the impeller appears if the ratio of diameter D1 of the first cylinder section 15 to the diameter D2 of the assembly plane 11—11 amounts to between 1.1 and 1.4, and preferably between 1.22 and 1.39. Since the acceleration path is elongated by the length of the second cylinder section 17 and its continuously decreasing diameter, the flow is further smoothed in the second cylinder section, so that the uniform incidence on the impeller is guaranteed to extend over the total cross-section thereof.

Figure 2:
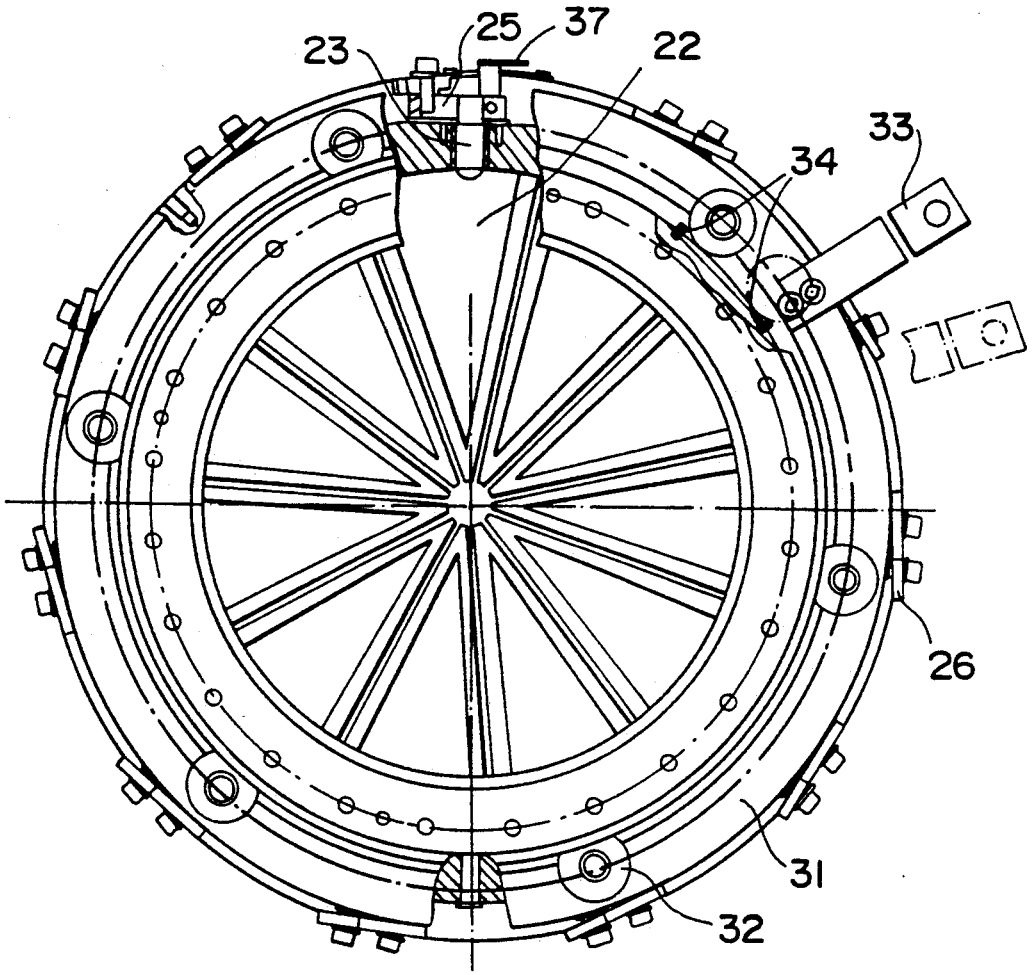
FIG. 2 is a top view of the axial drag regulator taken along the assembly plane II—II of FIG. 1.
Figure 3:
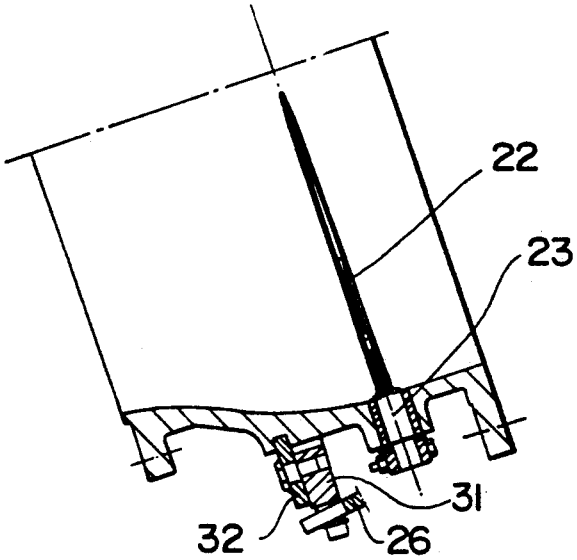
FIG. 3 is a partial section view through the housing of the axial drag regulator and the bearing of a guide vane in a closed condition.

Details of the shifting device of the diffusor are represented in FIGS. 2, 3, and 4. In a ring groove 30 in FIG. 5, an adjusting ring 31 is guided on the outside of the casing 10 of the axial drag regulator by means of roller elements 32 (FIG. 2). An adjustment arm 33 is connected with adjusting ring 31, upon which a not shown actuator motor acts which shifts the adjusting ring in a circumferential direction. Stops 34 are affixed to the casing 10, which cause the adjusting ring to be turned within an area which permits the adjustment of the guide Vanes only between 15° and −90°. The diffusor is totally closed at a vane position of −90° as shown in FIG. 2.

Figure 5:
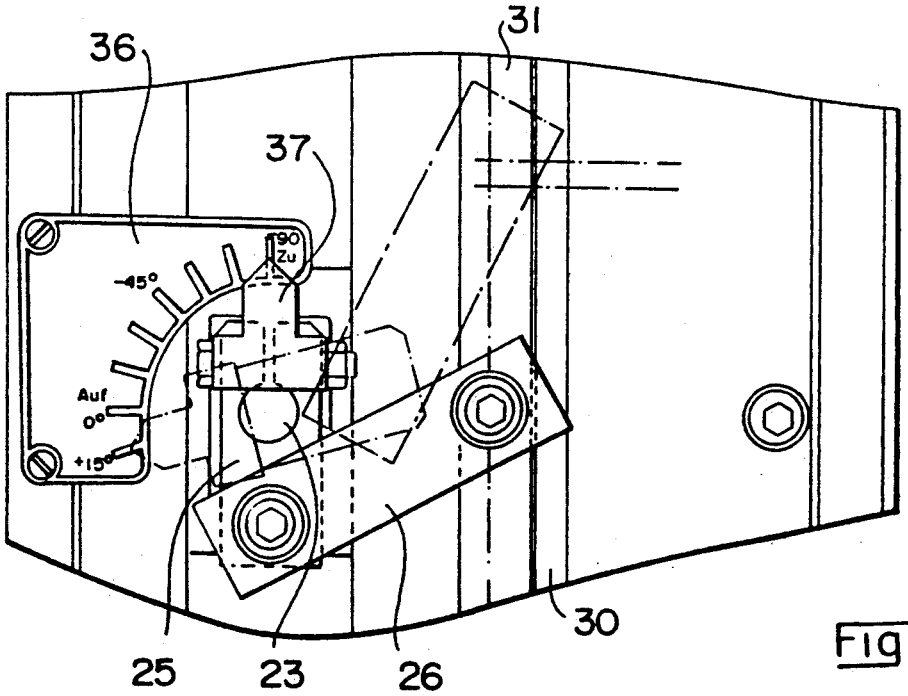
FIG. 5 is a top view of an adjusting device of a guide vane with a scale for showing the opening position.

As can additionally be seen from FIG. 5, an adjusting lever 25 is affixed to the rotatable axle shaft 23 of the guide vanes, and is connected to the adjusting ring 31 by means of a coupling member 26. Coupling member 26 is connected, on the one hand, with the adjusting ring 31 and with the adjustment lever 25 on the other hand. The levers are spatially rotatable with respect to one another, such that the coupling member has an angle of approximately 90° with respect to the adjusting lever in a medium position of the guide vanes within the usual rotation area or range, so that, in that area, the force acting on the coupling member is at a minimum and an especially balanced control is possible. The medium position of the adjustment area is coordinated with an angular displacement of the guide vanes and amounts to 0° and 30°.

FIG. 5 shows the position of the adjustment lever and the coupling member with respect to one another for the closed condition of the diffusor which is represented in full lines, and for the fully open condition of the diffusor in dash-dot lines. FIG. 5 also illustrates a scale 36 being affixed to the casing 10, which shows the angular position of a single guide vane of the diffusor by means of adjusting lever 25 being connected with indicator element 37. For this purpose, the indicator 37 extends in a longitudinal direction with respect to adjusting lever 25 (see FIG. 2). The articulate joint between the coupling member and the adjusting ring 31 on one hand, and with the adjustment lever 25, on the other hand, is carried out in a conventional manner. Likewise, the adjusting lever 25 is clamped to the rotatable axle shaft 23 in a conventional manner.

The diffusor described above can be used for a left-hand rotating compressor as well as for a right-hand rotating compressor making use of the same adjusting elements. For the accommodation to the opposite sense of rotation, only a mirror-inverted assembly is required.

The present disclosure relates to subject matter contained in German Patent Application No. P40 02 548.9-15 (filed Jan. 29, 1990) which is herein incorporated by reference in its entity.

Although the invention has been described with reference to particular means, materials and embodiments, it is to be understood that the invention is not limited to the particulars disclosed and extends to all equivalents within the scope of the claims.

What is claimed is:

1. Axial drag regulator for a large-volume radial compressor, comprising:

(a) an axial diffusor having a plurality of guide vanes extending in a radial direction with respect to an axis of said compressor, each guide vane being rotatable about a respective axis of rotation, each axis of rotation extending in a radial direction;

(b) said compressor including a flow channel having a cross-section, said guide vanes having a shape and pitch such that said guide vanes substantially cover the entire cross-section of the flow channel, when said guide vanes are in a completely closed position;

(c) said flow channel being located in a casing of the compressor, an inner wall of said casing, as seen in the direction of flow, including a first cylinder section and a spherical section, the spherical radius of said spherical section being substantially equal t the radius of said first cylinder section, and including a first transition area between said first cylinder section and said spherical section, said spherical section transitioning into a second cylinder section at a second transition area, a first end of said second cylinder section being adjacent said second transition area;

(d) each axis of rotation of said guide vanes dividing a face of a respective guide vane at a ratio of substantially $\frac{1}{3}:\frac{2}{3}$, the axes of rotation being located in said first transition area between said first cylinder section and said spherical section;

(e) the ratio of the diameter of said first cylinder section to the diameter of the second cylinder section at said first end being between 1.1 and 1.4;

(f) an impeller having an intake plane being located in said second cylinder, the diameter of said second cylinder decreasing from said first end to said intake plane of said impeller, wherein the decreasing of the diameter of said second cylinder forms an inclination in the range of slightly greater than 0° to 10° with respect to an axis which is parallel to said axis of the compressor; and (g) means for adjusting said guide vanes from an open position to a closed position.

2. The axial drag regulator according to claim 1, wherein the ratio of the diameter of said first cylinder section to said second cylinder section is between 1.22 and 1.39.

3. The axial drag regulator according to claim 1, wherein said inclination is not greater than 7°.

4. The axial drag regulator accordingly to claim 1, wherein said means for adjusting said guide vanes includes lever means connected at respective axes of rotation of said guide vanes, said levers extending outward along a respective axis of rotation and engaging an adjusting ring, said adjusting ring concentrically surrounding said casing, said lever means each comprising an adjusting lever being operably connected to a respective guide vane, and a coupling member being connected to said adjusting lever and being actuated by said adjusting ring.

5. The axial drag regulator according to claim 4, wherein each guide vane includes a rotatable axle shaft at a respective axis of rotation, said adjusting lever being connected to said rotatable axle shaft, and extends in the direction of the extension of the face of the guide vane.

6. The axial drag regulator according to claim 4, wherein at least one adjusting lever includes an indicator element to indicate the position of the guide vanes.

7. The axial drag regulator according to claim 6, comprising a scale on said casing for cooperation with said indicator element.

8. The axial drag regulator according to claim 4, comprising at least one stop to limit movement of said adjusting ring so that the movement of the guide vanes is between 15° and −90°, the guide vanes being completely closed at −90°.

9. The axial flow detector according to claim 4, comprising roller elements to support said adjusting ring on the outside of said casing, said roller elements running in a groove on the casing outside of said spherical section.

10. The axial drag regulator according to claim 4, wherein the angle between said adjusting lever and said coupling member is approximately 90° when the guide vanes are in a medium position.

11. The axial drag regulator according to claim 1, wherein each vane includes a larger portion and smaller portion on opposite sides of a respective axis of rotation, the larger portion extending into said spherical section when said guide vanes are in a totally open position.

12. The axial drag regulator according to claim 11, each vane including an edge having a leading edge and a trailing edge, said edge extending substantially flush from said trailing edge to the axis of rotation, along an inside face of said spherical section when said vanes are in the totally open position.

13. The axial drag regulator according to claim 12, comprising a small gap between each vane and an inside face of said cylindrical section extending from an axis of rotation to said leading edge of said guide vane.

* * * * *